United States Patent [19]

Roquebrune

[11] Patent Number: 4,993,087

[45] Date of Patent: Feb. 19, 1991

[54] BATHING APPARATUS FOR HANDICAPPED PEOPLE AND THE LIKE

[76] Inventor: Joseph P. A. Roquebrune, 6415 East Broadway, Burnaby, B.C., Canada

[21] Appl. No.: 388,795

[22] Filed: Aug. 2, 1989

[51] Int. Cl.[5] ..... A47K 3/02

[52] U.S. Cl. ..... 4/555; 4/604

[58] Field of Search ..... 4/555, 556, 560, 604, 4/605, 612, 613, 559, 584, 614

[56] References Cited

U.S. PATENT DOCUMENTS

| | | | |
|---|---|---|---|
| 3,380,078 | 4/1968 | Hanson | 4/555 |
| 3,416,166 | 12/1968 | Hanson | 4/555 |
| 4,112,524 | 9/1978 | Johansson | 4/560 X |
| 4,365,367 | 12/1982 | Houle et al. | 4/555 |
| 4,546,506 | 10/1985 | Houle et al. | 4/555 |
| 4,583,251 | 4/1986 | Fürst et al. | 4/555 |
| 4,757,561 | 7/1988 | Crump | 4/604 |
| 4,796,312 | 1/1989 | Corlew | 4/555 |

FOREIGN PATENT DOCUMENTS

| | | | |
|---|---|---|---|
| 1478999 | 3/1967 | France | 4/555 |
| 1213358 | 11/1970 | United Kingdom | 4/555 |
| 1226206 | 3/1971 | United Kingdom | 4/555 |
| 1582900 | 1/1981 | United Kingdom | 4/555 |
| 863389 | 6/1986 | World Int. Prop. O. | 4/559 |

*Primary Examiner*—Henry J. Recla
*Assistant Examiner*—Robert M. Fetsuga
*Attorney, Agent, or Firm*—Townsend and Townsend

[57] ABSTRACT

A bathtub having one panel which slides down, allows entrance for a handicapped person in a wheelchair or on a trolley without having to climb over the side. The bathtub permits a handicapped person to be independent and not rely on others. One fixed vertical side is joined to two end walls extending up from a bottom surface to form a bathtub, a sliding panel, representing the other vertical side of the bathtub in a raised position, is mounted in tracks in the two end walls, the tracks extend down allowing the sliding panel to be lowered to a lowered position to permit entry and exit. The sliding panel can be raised and lowered between the lowered and raised positions, and a seal is provided to seal the panel in the raised position.

3 Claims, 3 Drawing Sheets

BATHING APPARATUS FOR HANDICAPPED PEOPLE AND THE LIKE

BACKGROUND OF THE INVENTION

The present invention relates to a bathtub and more particularly to a bathtub that has a side or front panel which slides downwards to allow a handicapped person in a wheelchair or on a trolley to move into the bathtub without having to climb over a side of the bathtub.

Handicapped people, such as paraplegics, and elderly people often require assistance to climb over the side of a bathtub. Whereas this may be acceptable in hospitals and in homes for the elderly, it always requires another person to be present which does not permit independence in the home.

Various attempts have been made to provide a bathtub that a handicapped person can use by himself. Some of these include bathtubs with special seats and sliding panels that lift up. One example of such a bathing arrangement is disclosed by the Houle et al. in U.S. Pat. No. 4,365,367. Another type of bathtub is provided by Hanson in U.S. Pat. No. 3,416,166 which shows a sliding door to lift up and move to one side and rest on a rail assembly thus providing an access into a bathtub. None of these units, however, permit an individual in either a wheelchair or on a trolley of some kind to advance into the bathtub and there is a need for such a bathtub for use in hospitals and in the home.

SUMMARY OF THE INVENTION

It is an aim of the present invention to provide a bathing apparatus which has a side panel that drops down so that the bottom surface of the bathtub is substantially level with the floor, or alternatively has a ramp to allow an individual on a trolley or a wheelchair to roll directly into the bathtub.

It is a further aim of the present invention to provide a bathtub that can be used by a handicapped person who does not have full use of any or all limbs and yet can have a bath on his own without having to be assisted by another individual. It is a further aim to provide a bathtub system which can be adapted for use by either voice actuation or manual operation. A voice actuation can operate the sliding side panel and also control the flow and temperature of water into the bathtub, also drain the water out of the bathtub.

The present invention provides a bathing apparatus for handicapped people and the like comprising a bathtub having one fixed vertical side joined to two end walls extending up from a bottom surface, a sliding panel representing the other vertical side of the bathtub in a raised position, the sliding panel mounted in track means in the two end walls external of the bathtub, the track means extending downwards allowing the sliding panel to be lowered to a lowered position to permit entry and exit to the bathtub, means to raise and lower the sliding panel between the lowered postion and the raised position and sealing means to effect a seal for the sliding panel in the raised position.

BRIEF DESCRIPTION OF THE DRAWINGS

In drawings which illustrate embodiments of the invention.

DETAILED DESCRIPTION OF THE PREFERRED EMBODIMENTS

Figure 1:
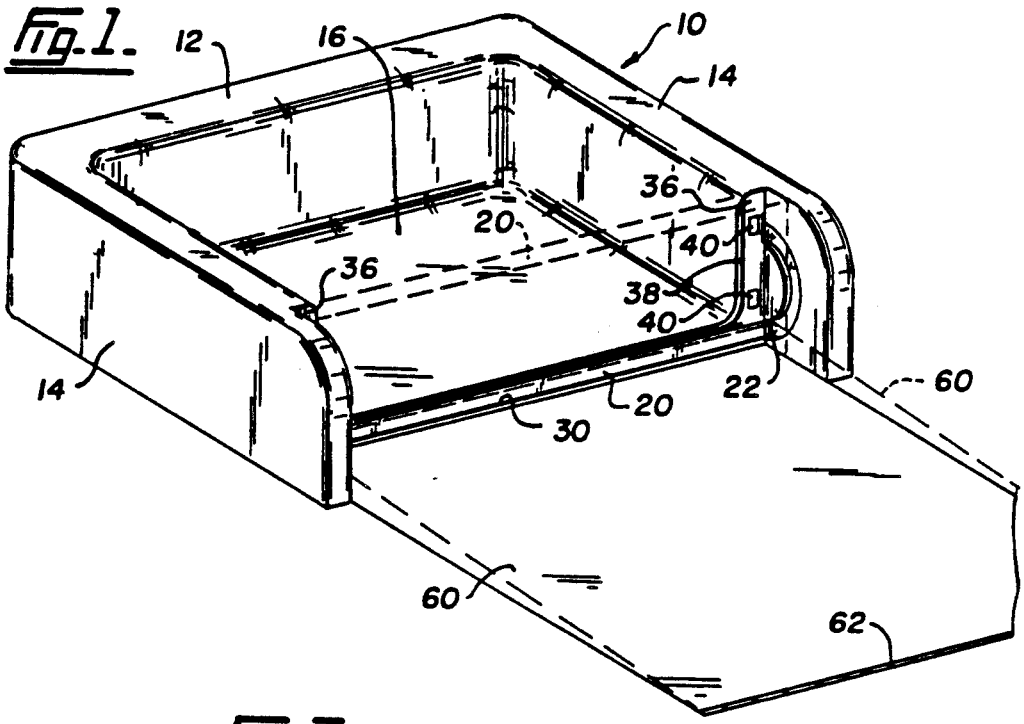
FIG. 1 is an isometric view showing another embodiment of a bathtub according to the present invention.
Figure 2:
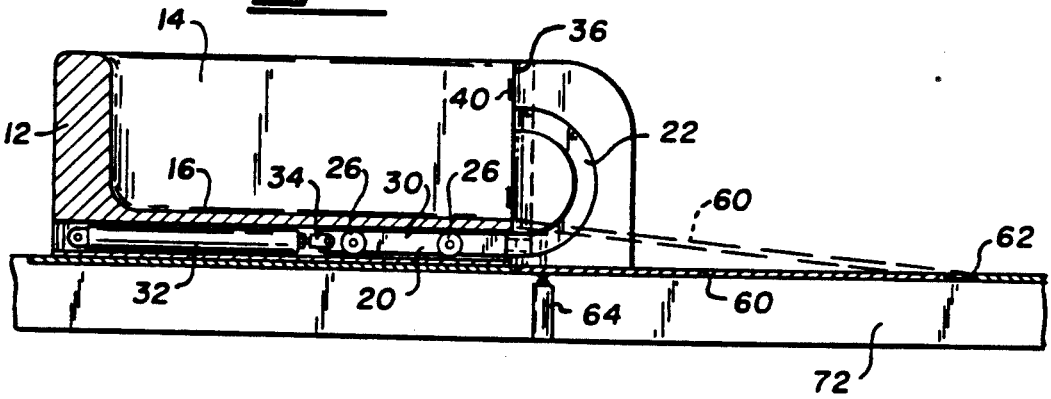
FIG. 2 is a side sectional view of the bathtub shown in FIG. 1.
Figure 3:
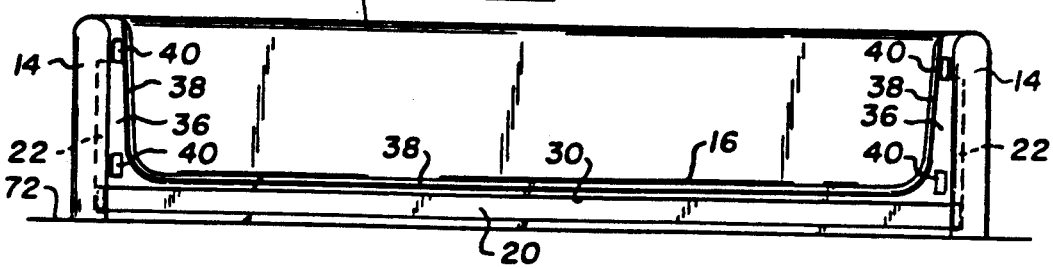
FIG. 3 is a front view of the bathtub shown in FIG. 1 showing the sliding panel of the bathtub in the open or lowered position.

Most bathtubs today are made of fiberglass, and this is the preferred material for the bathing apparatus of the present invention which includes a bathtub 10 as shown in FIGS. 1 to 3 with a fixed side 12 joined to two end walls 14. As can be seen more easily in FIGS. 2 and 3 the bottom 16 of the tub is integral with the fixed side wall 12 and end walls 14.

The other side of the bathtub 10 has a sliding panel 20 which has tracks 22 at each side fitting in the ends 14, which extend outwards beyond the edge of the bathtub 10. The panel 20 has side rollers 26 at each end which each fit into a guide track 22. An opening 30 is provided under the bathtub 10 and the panel 20, when lowered from the raised position to the lowered position slides in the curved guide tracks 22 and moves down into the opening 30 under the bathtub 10. Two hydraulic cylinders or linear actuators 32 are provided underneath the bathtub 10 with a link or swivel 34 to join to the panel 20 so that when the panel is pushed out of the opening 30 and turns to move into the raised position, the swivel 34 allows the turn to be made. In the reverse operation, as the linear actuator pulls on the swivel 34, the panel turns on the curved guide tracks 22 through 90° and slides into the opening 30.

As seen more clearly in FIG. 3, an edge 36 extends along the bottom 16 of the bathtub and at the two end walls 14. The edge 36 has a rubber strip seal 37 extending there along and four electromagnets 40 are positioned on the edge 36 at each end wall 14 which when activated retains the sliding panel 20 in the closed position, assisting in sealing the panel 20 to the bathtub 10 by means of the rubber strip 38.

Both the linear actuators 32 and the electromagnets are operated by twelve volts DC. A twelve volt battery with a battery charger is provided so the battery remains constantly charged, and in the event of a power failure the movement of the panel is not affected. The electrical control system for the complete bath including electrical sensors, limit switches and the like are all twelve volt DC. By using twelve volts the safety of an individual is ensured as this voltage does not provide a harmful electric shock, and is accepted in accordance with Federal Standards.

At the entrance to the bathtub 10, as shown in FIG. 1 and 2, is a ramp 60 extending from hinge 62 ending just prior to the edge of the bathtub 10. When the panel 20 is in the lowered position, a hydraulic or linear actuator 64 raises the ramp 60 to approximately the height of the bottom 16 of the bathtub 10 so that a wheelchair, gurney, trolley or the like may roll straight into the bathtub 10. The linear actuator 64 is shown positioned in the floor joists, however if no room is available here, then a side actuating unit may be provided which fits on top of the floor rather than underneath. In this manner the bathtub 10 shown in FIGS. 1, 2 and 3 may be installed in a standard residential house without having to cut holes in the floor.

Figure 4:
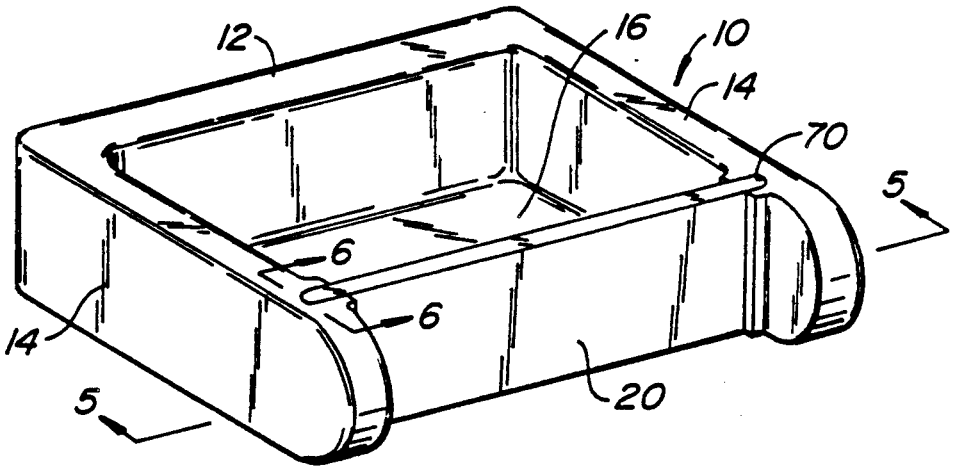
FIG. 4 is an isometric view showing one embodiment of a bathing apparatus according to the present invention.
Figure 5:
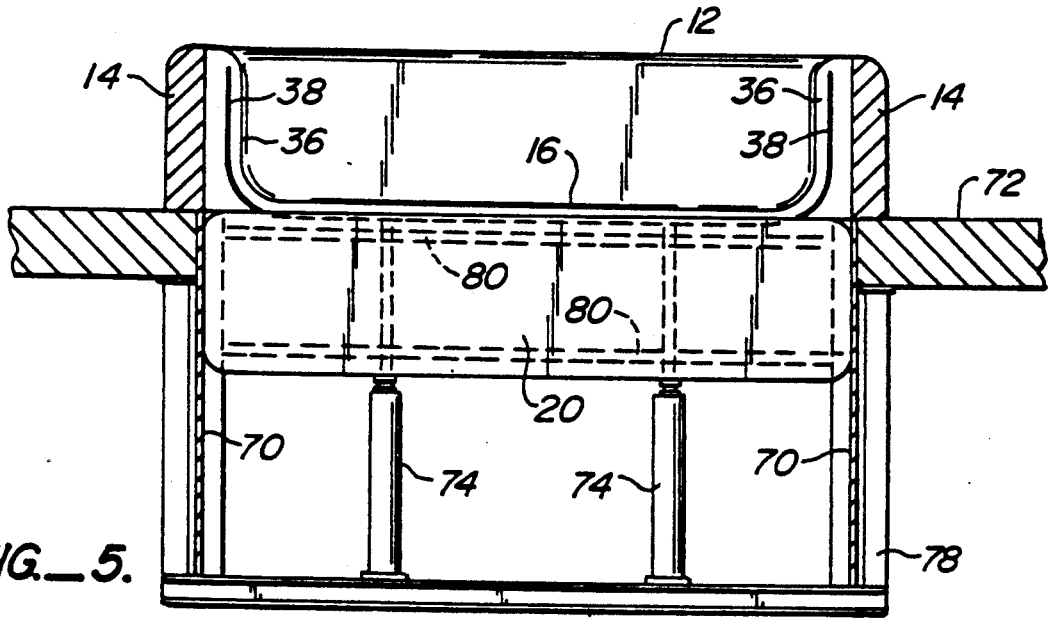
FIG. 5 is a cross-sectional view taken at line 5—5 of FIG. 4 showing the sliding panel of the bathtub in the lowered position.
Figure 6:
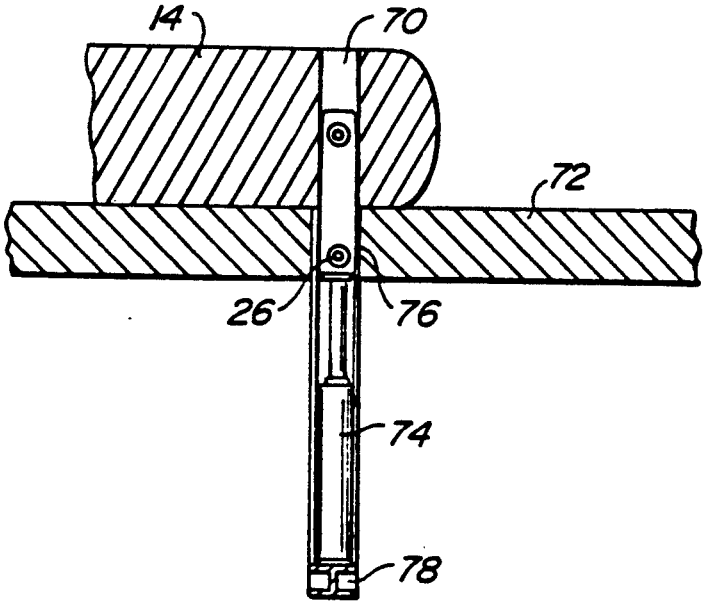
FIG. 6 is a cross-sectional view taken at line 6—6 of FIG. 4 with the sliding panel partially lowered.

Another embodiment of a bathtub is shown in FIGS. 4, 5 and 6 where the sliding panel 20 is tapered with a thinner top than a base, and has grooves 70 in each of the ends 14 tapered to match the sliding panel 20. In a raised position the sliding panel 20 wedges into the grooves 70, and the seal 38 in the edge 36 around the two end walls 14 and along the bottom 16 of the bathtub seals against the surface of the panel 20. The wedge action assists in forming the seal and prevents water escaping. The grooves 70 extend down below the floor 72, and two hydraulic cylinders or linear actuators 74 are shown to lower the sliding panel 20 to a lowered position through a slot 76 in the floor 72, as illustrated in FIG. 5, so that the top of the panel 20 is substantially level with the bottom surface 16 of the bathtub. This allows a person in a wheelchair or trolley to move over the lowered panel 20. Alternatively a ramp similar to that shown in FIGS. 1 and 2 may be provided. At the edges of the panel 20 rollers or guides 26 fit into the grooves 70 to provide a smooth travel path.

As illustrated in FIGS. 5 and 6, a frame 78 is provided beneath the bathtub 10 to act as a support for the hydraulic cylinders 74 and the sliding panel 20.

The sliding panel 20 is also made of fiberglass similar to the rest of the bathtub 10, but has steel reinforcing bars 70 embedded therein to provide longitudinal strength to ensure the panel 20 retains its shape even when the bathtub 10 is full of water. The steel reinforcing bars 80 are provided in the sliding panels 20 as shown in FIG. 5.

The embodiment shown in FIGS. 4, 5 and 6 is suitable for hospitals and the like and requires a slot 76 in the floor 72 and a frame 70 mounted under the floor 70. Such an installation can generally be made in existing buildings. FIGS. 1, 2 and 3 illustrate an embodiment of a bathtub 10 which does not require a slot 76 in the floor 72.

Various dimensions of bathtubs may be provided. For quadraplegics or the like where a patient has to enter the bathtub on a gurney or trolley, specially designated for use in water and to fit into the bathtub, bathtubs having lengths of eight feet or more may be provided.

For household use smaller bathtubs, even those of five feet in length may be provided. Bathtub faucets may be hand operated or have 12 volt electric solenoids for operation. A temperature sensing control may also be provided so that the temperature may be preselected. The drain may also have a solenoid operated valve, and in some instances two drains may be provided one at each end of the tub. Large faucets or two faucets may also be provided for quick filling. This is particularly true in a hospital but may not be necessary for residential use. Heat sensors may also be included for determining water temperature.

A water sensor is also provided in the bathtub to prevent opening of the sliding panel when the bathtub is full of water. This sensor may include a timing sensor which does not allow the side to be opened until the solenoid valve of the drain has been opened for a predetermined time to ensure that no water remains in the bathtub.

Figure 7:
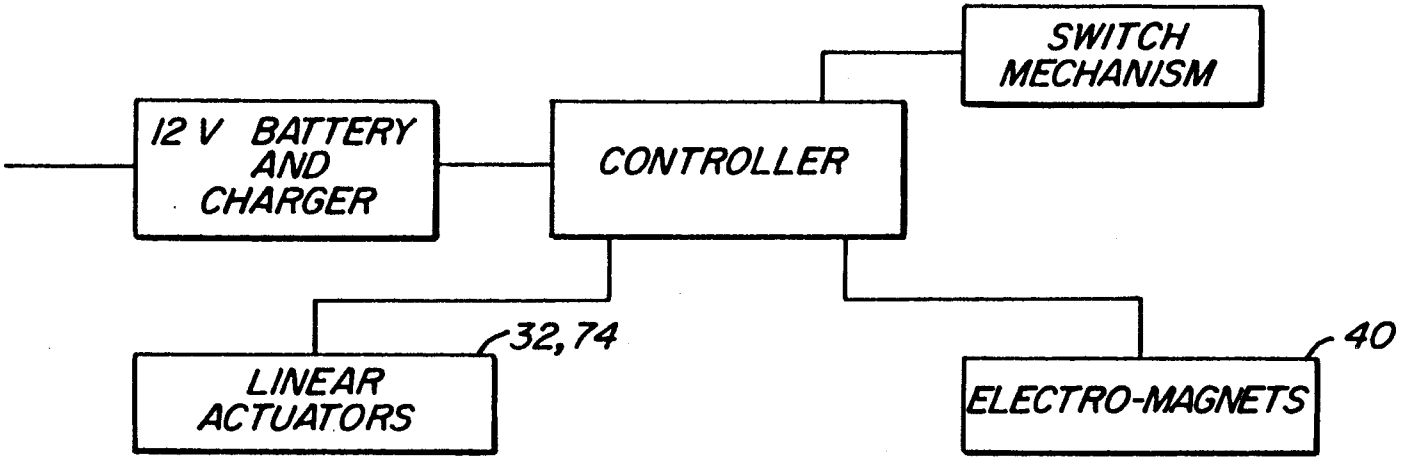
FIG. 7 is a block diagram of a control system for operating the bathtub depicted in FIGS. 1–6.

As previously stated the electrical system is twelve volt DC with a battery charger for connection to household power. Thus in case of a power failure the system still continues to operate. Furthermore by utilizing twelve volts you avoid the problems of high voltage in a bathroom. Control of a bathtub may be by a small computerized unit to perform all functions. FIG. 7 shows a blank diagram of such a system. As previously stated a voice actuator may be used as a switch mechanism to control operating the bathtub. The voice actuator may be used to control every function and any other provided features. In the case of a voice actuated control the different commands would operate different functions. Furthermore it is possible to program the actuation system so that only one person's voice operates the different controls. Overrides and manual operation may of course be provided.

Various changes may be made to the embodiments disclosed herein without departing from the scope of the present invention which is limited only by the following claims.

The embodiments of the present invention in which an exclusive property or privilege is claimed are defined as follows:

1. A bathing apparatus for handicapped people and the like comprising:

a bathtub having one fixed vertical side joined to two end walls extending up from a bottom surface, a sliding panel representing the other vertical side of the bathtub in a raised position, the sliding panel mounted in track means in the two end walls external of the bathtub, the track means extending vertically downwards allowing the sliding panel to be lowered vertically from a raised position to a lowered position to permit entry and exit to the bathtub, wherein the sliding panel is tapered having a narrow thickness at the top and fits in mating tapered slots defining said track means in the two end walls.

means to raise and lower the sliding panel between the lowered position and the raised position, and sealing means to effect a seal for the sliding panel in the raised position.

2. The bathing apparatus according to claim 1 wherein the means to raise and lower the sliding panel comprises at least one electrical linear actuator.

3. The bathing apparatus according to claim 1 wherein the track means comprises rails and including rollers on the ends of the sliding panel to run on the rails.

* * * * *